US006212977B1

(12) United States Patent
Liou

(10) Patent No.: US 6,212,977 B1
(45) Date of Patent: Apr. 10, 2001

(54) SPRING CHUCK

(76) Inventor: Ferng-Jong Liou, No. 101 Jong Shing Roan. Sec. 2, Dah-Lii City, Taichung Hsien (TW)

( * ) Notice: Subject to any disclaimer, the term of this patent is extended or adjusted under 35 U.S.C. 154(b) by 0 days.

(21) Appl. No.: 09/441,046

(22) Filed: Nov. 16, 1999

(51) Int. Cl.[7] ..... B25B 7/14; B25B 7/12

(52) U.S. Cl. ..... 81/323; 81/302; 81/324; 269/166; 269/170

(58) Field of Search ..... 269/166, 170; 81/302, 318, 319, 320, 323, 324, 424

(56) References Cited

U.S. PATENT DOCUMENTS

| | | | | |
|---|---|---|---|---|
| 2,620,697 | * | 12/1952 | Sarvie | 81/323 X |
| 3,313,190 | * | 4/1967 | Bothum | 81/323 |
| 4,602,535 | * | 7/1986 | Wiener et al. | 81/323 X |
| 5,469,765 | * | 11/1995 | Franklin | 81/324 |
| 5,791,210 | * | 8/1998 | Wolff et al. | 81/424 X |

* cited by examiner

*Primary Examiner*—James G. Smith
(74) *Attorney, Agent, or Firm*—Bacon & Thomas, PLLC

(57) ABSTRACT

A spring chuck having a locking mechanism provided between two handles of the spring chuck. The locking mechanism includes a sleeve connected at an end to one handle of the chuck, a shaft having an end connected to another handle of the chuck and another end movably located in the sleeve via a lower open end thereof, a brake handle having a ring-shaped head put around the shaft and pivotally connected the lower open end of the sleeve, and a compression spring mounted around the shaft between the sleeve and the ring-shaped head of the brake. The compression spring normally pushes the ring-shaped head to pivotally turn away from the sleeve to frictionally contact with the shaft, preventing the shaft from moving in the sleeve and thereby lock the handles of the chuck to a fixed position. Pushing the brake handle toward the sleeve causes the ring-shaped head to align with the sleeve without frictionally contacting with the shaft and therefore allows the handles of the chuck to move freely.

3 Claims, 3 Drawing Sheets

SPRING CHUCK

BACKGROUND OF THE INVENTION

1. Field of the Invention

The present invention relates to a spring chuck, and more particularly to an improved spring chuck provided with a locking mechanism to hold two handles of the spring chuck at desired position, preventing the spring chuck from unexpected loosening during working.

2. Description of the Related Art

There are various types of spring chucks available in the markets. These spring chucks are, however, similar in their structural design and mainly include a spring to achieve the function of tightly clamping working pieces between two jaws thereof. Since there is not any auxiliary locking mechanism designed for such conventional spring chucks, jaws of these chucks tend to unexpectedly separate from each other when considerably thick working pieces, such as two planks, are clamped between the jaws for machining, such as cutting and drilling, and the spring chucks are subjected to vibration or external force during such machining. The quality of produced items would therefore be seriously and adversely affected.

It is therefore desirable to develop a locking mechanism for the spring chucks, so that the spring chucks provide safe and good clamping effect to ensure convenient use thereof and best production of desired items.

SUMMARY OF THE INVENTION

A primary object of the present invention is to provide a spring chuck having an auxiliary locking mechanism to lock handles of the spring chuck to a desired position, so that safe and firm clamping of working pieces between jaws of the chuck can be ensured.

BRIEF DESCRIPTION OF THE DRAWINGS

The structure and technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
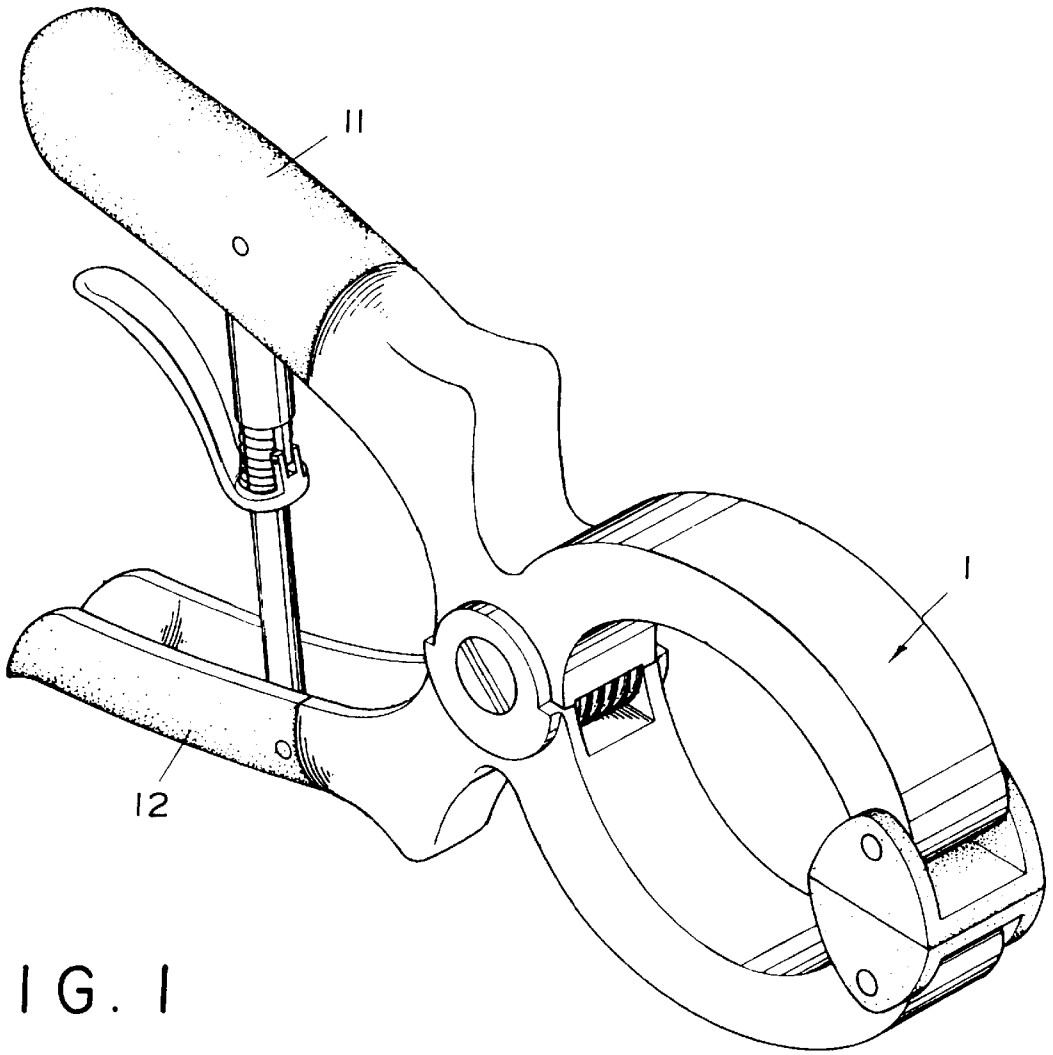
FIG. 1 is a perspective of the spring chuck according to the present invention.
Figure 2:
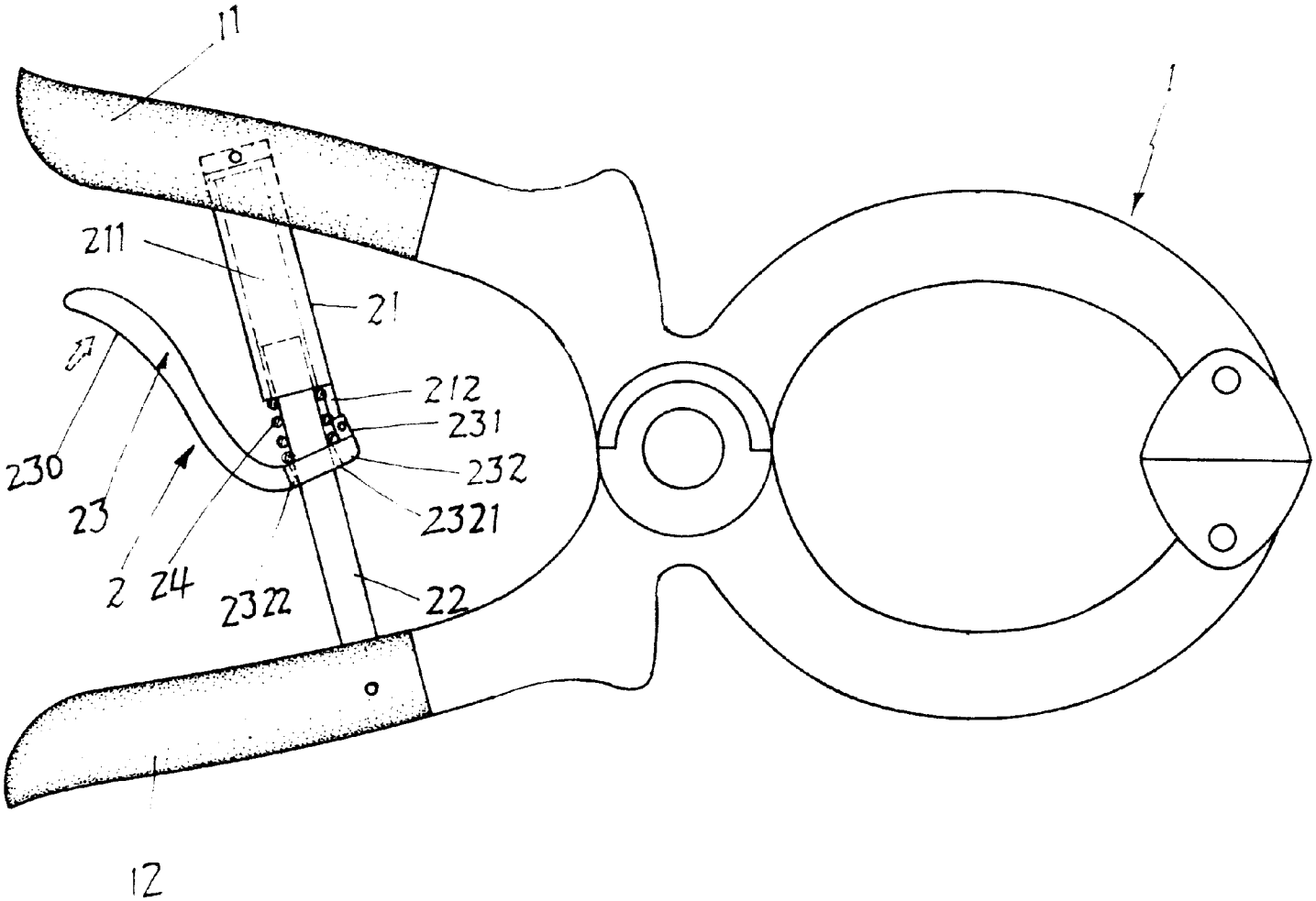
FIG. 2 is a plan view of the spring chuck of FIG. 1.
Figure 3:
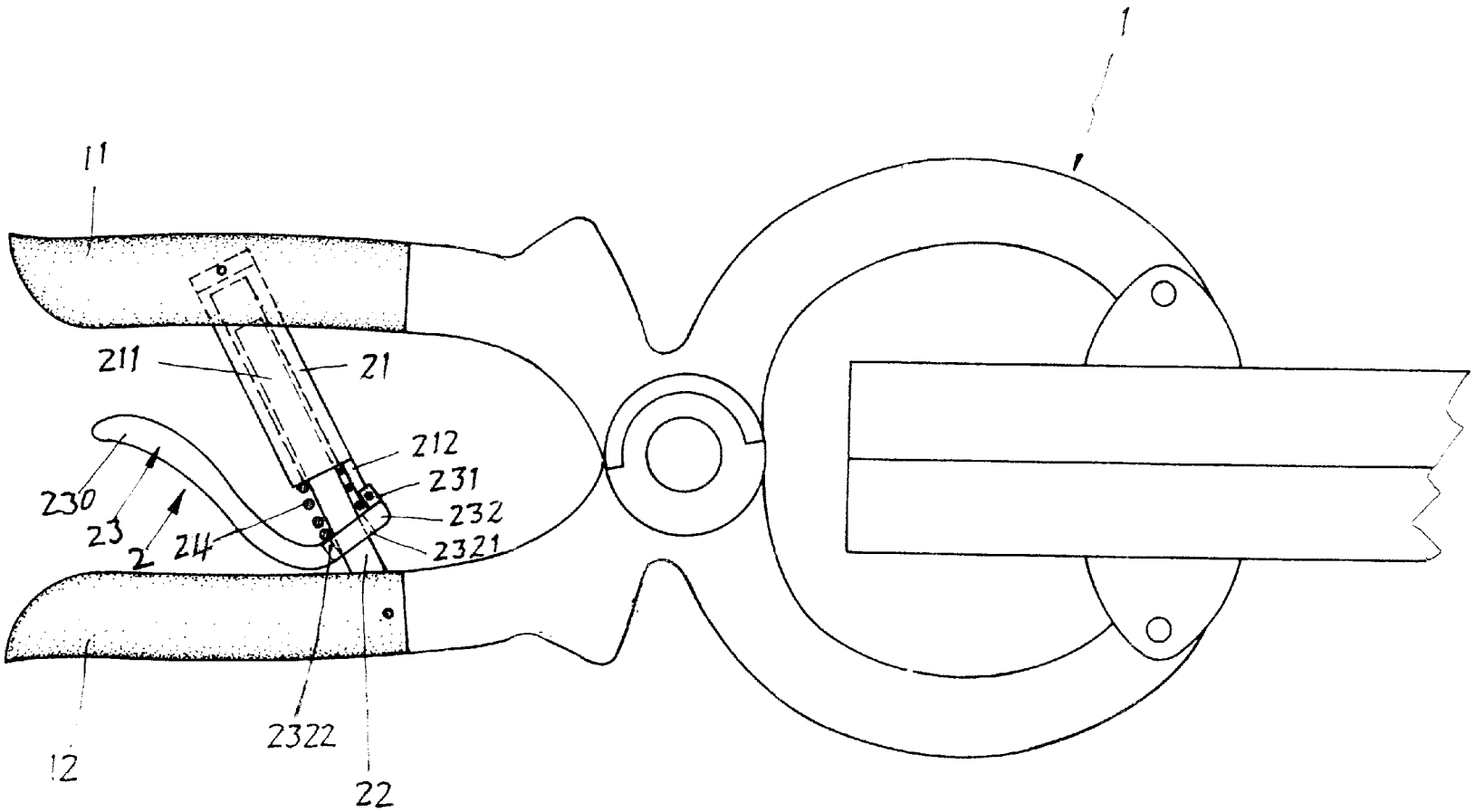
FIG. 3 is another plan view of the spring chuck of FIG. 1 in a working state with handles thereof set in a locked position.

Please refer to FIGS. 1 to 3. A spring chuck 1 according to the present invention includes a locking mechanism 2 provided between a pair of handles, that is, a first handle 11 and a second handle 12 of the spring chuck 1.

The locking mechanism 2 mainly includes a sleeve 21, a shaft 22, a brake 23, and a compression spring 24.

The sleeve 21 is fixedly connected at an upper end to a predetermined point on an inner side surface of the first handle 11 in a predetermined manner. The sleeve 21 defines an inner space 211 for an end of the shaft 22 to movably locate in the inner space 211 via a lower open end of the sleeve 21. The lower open end of the sleeve 21 is provided at one side, preferably the side facing toward a front end (or jaws) of the spring chuck 1, with a downward extended lug 212. Another end of the shaft 22 is fixedly connected to a predetermined point on an inner side surface of the second handle 12.

The brake 23 includes a handle 230, a ring-shaped head 232 that forms a lower front portion of the handle 230, and a U-shaped lug 231 upward extended from one side of the ring-shaped head 232 corresponding to the lug 212 of the sleeve 21. The brake 23 is movably connected to the sleeve 21 by pivotally connecting the U-shaped lug 231 to the lug 212, so that a predetermined distance exists between the lower open end of the sleeve 21 and the ring-shaped head 232 of the brake 23. The ring-shaped head 232 defines a central hole 2321, an inner diameter of which is slightly larger than an outer diameter of the shaft 22. The compression spring 24 is mounted around the shaft 22 at a position between the lower open end of the sleeve 21 and the ring-shaped head 232 of the brake 23. When the first and the second handles 11, 12 of the spring chuck 1 are not subjected to any external force pressing them toward each other, the compression spring 24 normally pushes the ring-shaped head 232 to pivotally turn away from the sleeve 21.

When the compression spring 24 elastically pushes the brake 23 from the sleeve 21, the pivotal connection of the U-shaped lug 231 to the lug 212 brings the ring-shaped head 232 and accordingly the central hole 2321 thereof to an inclined position relative to the shaft 22, causing the shaft 22 to frictionally contact with an inner wall surface 2322 of the hole 2321. Such frictional contact of the shaft 22 with the hole 2321 of the brake 23 in turn locks the first and the second handles 11, 12 to an unmoved state.

When a force is applied to push the handle 230 of the brake 23 toward the sleeve 21, the central hole 2321 of the ring-shaped head 232 of the brake 23 is brought to a position aligned with the inner space 211 of the sleeve 21. At this point, the shaft 22 separates from the inner wall surface 2322 of the central hole 2321 of the brake 23, allowing the shaft 22 to freely move in the sleeve 21. That is, the first and the second handles 11, 12 of the spring chuck 1 can be moved toward or away from each other. And, when the handle 230 of the brake 23 is released, the compression spring 24 immediately pushes the ring-shaped head 232 of the brake 23 to the inclined position to frictionally contact with the shaft 22 and accordingly locks the first and the second handles 11, 12 to a previously set position.

With the above arrangements, the spring chuck 1 of the present invention could be conveniently used to safely and firmly hold working pieces simply by pushing the brake handle 230 inward with a finger to free the chuck handles 11, 12 and releasing the brake handle 230 to lock the chuck handles 11, 12 to a desired position.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A spring chuck comprising:

first and second handles, and a locking mechanism provided between said first and second handles;

said locking mechanism including a sleeve, a shaft, a brake, and a compression spring;

said sleeve being fixedly connected at an upper end to a predetermined point on an inner side surface of said first handle and defining an inner space;

said brake slidably attached along the shaft and positioned outside of the sleeve;

said shaft being fixedly connected at a lower end to a predetermined point on an inner side surface of said second handle with an upper end thereof movably located in said inner space of said sleeve via a lower open end of said sleeve; and wherein the locking mechanism is always positioned between said handles and the compression spring exerts pressure on one side of said brake such that said brake releasably locks onto said shaft.

2. The spring chuck as claimed in claim 1, wherein said lower open end of said sleeve is provided at a side facing toward a front end of said spring chuck with a downward extended lug, and wherein said brake includes a brake handle having a ring-shaped head at a lower front thereof and a U-shaped lug upwardly extending from a side of said ring-shaped head corresponding to said lug of said sleeve, said brake being movably connected to said sleeve by pivotally connecting said U-shaped lug to said sleeve lug, so that a predetermined distance exists between said lower open end of said sleeve and said ring-shaped head of said brake for said compression spring to mount around said shaft between said lower open end of said sleeve and said ring-shaped head of said brake.

3. The spring chuck as claimed in claim 2, wherein said ring-shaped head of said brake defines a central hole having an inner diameter slightly larger than an outer diameter of said shaft, whereby when said handle of said brake is not subjected to any external force pressing it toward said sleeve, said compression spring normally pushes said ring-shaped head of said brake to pivotally turn away from said sleeve, bringing said ring-shaped head of said brake into an inclined position relative to said shaft and to frictionally contact with said shaft to prevent said shaft from moving in said inner space of said sleeve and thereby locks said first and said second handles of said spring chuck to a fixed position, and when said handle of said brake is pressed toward said sleeve, said ring-shaped head of said brake is brought to a position aligned with said inner space of said sleeve for said shaft to separate from the frictional contact with said ring-shaped head of said brake, allowing said shaft to freely move in said sleeve and said first and said second handles of said spring chuck to move toward or away from each other.

* * * * *